US006434798B1

(12) United States Patent
Yamakawa et al.

(10) Patent No.: US 6,434,798 B1
(45) Date of Patent: Aug. 20, 2002

(54) ROTATION STOPPER FOR OPENING AND CLOSING PLATES IN CENTER FIXING DEVICE OF BAND-SHAPED ORNAMENT

(75) Inventors: Jindai Yamakawa, Tanashi; Kaname Atsumi, Tokyo, both of (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/486,813

(22) PCT Filed: Jun. 30, 1999

(86) PCT No.: PCT/JP99/03533

§ 371 (c)(1),
(2), (4) Date: Mar. 2, 2000

(87) PCT Pub. No.: WO00/01269

PCT Pub. Date: Jan. 13, 2000

(30) Foreign Application Priority Data

Jul. 2, 1998 (JP) ..... 10-187148

(51) Int. Cl.[7] ..... A44B 11/00; A44C 5/24
(52) U.S. Cl. ..... 24/71 J; 24/68 J; 24/265 WS
(58) Field of Search ..... 24/71 J, 68 J, 24/265 WS

(56) References Cited

U.S. PATENT DOCUMENTS

| | | | | | |
|---|---|---|---|---|---|
| 1,892,060 | A | * | 12/1932 | Kestenman | 24/71 J |
| 5,005,268 | A | * | 4/1991 | Hartmann | 24/265 WS |
| 5,485,659 | A | * | 1/1996 | Kashikie et al. | 24/68 J |
| 5,711,056 | A | * | 1/1998 | Taguchi et al. | 24/71 J |
| 5,857,243 | A | * | 1/1999 | Champion | 24/71 J |
| 6,023,816 | A | * | 2/2000 | Okada et al. | 24/71 J |

FOREIGN PATENT DOCUMENTS

| | | | | |
|---|---|---|---|---|
| EP | A1-0319461 | | 6/1989 | |
| FR | 2619292 | | 2/1989 | |
| JP | 7-116009 | | 5/1995 | |
| JP | 9-252814 | | 9/1997 | |
| WO | 8400285 | * | 2/1984 | 24/71 J |

* cited by examiner

*Primary Examiner*—Victor N. Sakran

(57) ABSTRACT

There is provided a pair of open plates 3 rotatably connected to both ends of a base 1 and adapted to be oppositely opened from closed positions. The open plates are held at the closed position by holding means 5, 6. Stopping means 15, 16 are provided for stopping the open plates halfway of an opening operation.

26 Claims, 20 Drawing Sheets

ROTATION STOPPER FOR OPENING AND CLOSING PLATES IN CENTER FIXING DEVICE OF BAND-SHAPED ORNAMENT

This application is the national phase under 35 U.S.C. § 371 of PCT International Application No. PCT/JP99/03533 which has an International filing date of Jun. 30, 1999, which designated the United States of America.

TECHNICAL FIELD

The present invention relates to a buckle for a personal adornment band such as a watch, necklace, and bracelet, and more particularly to a device for limiting the rotation of an open plate provided in the buckle.

BACKGROUND ART

FIG. 28 is a perspective view showing an opposed buckle for a watch which opens like a casement window.

The buckle comprises a base 1 and a pair of open plates 3 each of which is rotatably connected to the base 1 at a base end thereof by a pin 2.

The base 1 is a frame comprising a pair of frame members 4 at both sides, pins 2 at both ends, and a pair of open plate fixing pins 5, and is curved so as to conform to the curvature of a wrist. Each of the open plates 3 is adapted to be engaged between the frame members 4, and further has a pair of grooves 6 and 7 at the inner surface.

When the open plate 3 is closed, the outer groove 6 engages with the pin 5, a wall 8 between the grooves yielded to abut against the pin 5. Hence the open plate is held so as not to open.

Such a buckle is attached to a personal adornment band, for example, a wristwatch comprising a watch 13 and a watchband 10 as shown in FIG. 29. At each of the outer ends of the open plates, an end link 11 of the watchband 10 is rotatably connected by a pin 12.

FIG. 29 shows the state where the watch 13 provided with the buckle is worn on a wrist 14.

The base 1 of the buckle is put on the inner side of the wrist 14. Due to the weight of the watch 13, the open plates 3 of the buckle are opened, thereby touching the wrist. Each open plate 3 must be held with the fingers of the right hand and raised, rotated, and fixed to the frame members 4 from such a state.

However, since the open plates 3 touch the wrist, it is difficult to grip the open plates, and moreover, the angle which each open plate must rotate is large.

Hence, it is difficult to close the open plates 3, particularly so if the watch 13 and the band 10 are heavy.

Thus, an object of the present invention is to provide a device for limiting the rotation of the open plates, which enables the personal adornment band to be easily worn.

DISCLOSURE OF THE INVENTION

According to claim 1 of the present invention, there is provided a device for limiting a rotation of an open plate provided in a buckle for a personal adornment band, comprising, a base, the open plate rotatably connected by a pivot to at least one end of the base, holding means for holding the open plate at a closed position, and stopping means for stopping the open plate halfway of an opening operation.

According to claim 16 of the present invention, there is provided a device for limiting rotations of a pair of open plates provided in a buckle for a personal adornment band, the buckle comprising a base, the open plates rotatably connected to both ends of the base and adapted to be oppositely opened from closed positions, and holding means for holding the open plates at closed positions, wherein stopping means is provided for stopping the open plates halfway of an opening operation, and an angle formed between the open plate and a base line passing joints of the open plate at the stop positions thereof is within a range between about 65 in the angle of elevation and about 85 degrees in the angle of depression.

According to claim 20 of the present invention, there is provided a device for limiting rotations of a pair of open plates provided in a buckle for a personal adornment band, the buckle comprising a base, the open plates rotatably connected to both ends of the base and adapted to be oppositely opened from closed positions, and holding means for holding the open plates at closed positions, wherein stopping means is provided for stopping the open plates halfway of an opening operation, and an inner circumference of a ring formed by the personal adornment band and the buckle connected to the end of each open plate at the stop positions thereof is slightly larger than an outer circumference of a wrist.

According to claim 23 of the present invention, there is provided a device for limiting rotations of a pair of open plates provided in a buckle for a personal adornment band, the buckle comprising a base, the open plates rotatably connected to both ends of the base and adapted to be oppositely opened from closed positions, and holding means for holding the open plates at closed positions, wherein stopping means is provided for stopping the open plates halfway of an opening operation, and the open plates do not touch a wrist of a wearer at the stop positions thereof.

In accordance with these constructions, the open plates can be stopped halfway of an opening operation. Thus the open plates can be easily gripped and the angle which each open plate must rotate is decreased. As a result, the closing operation of the open plates is facilitated.

In addition, there is disclosed a range of the angle at which the open plates are to be stopped. Hence the open plates can be easily closed while maintaining the ease at which the personal adornment band can be worn or taken off.

BEST MODE FOR EMBODYING THE INVENTION

Figure 1:
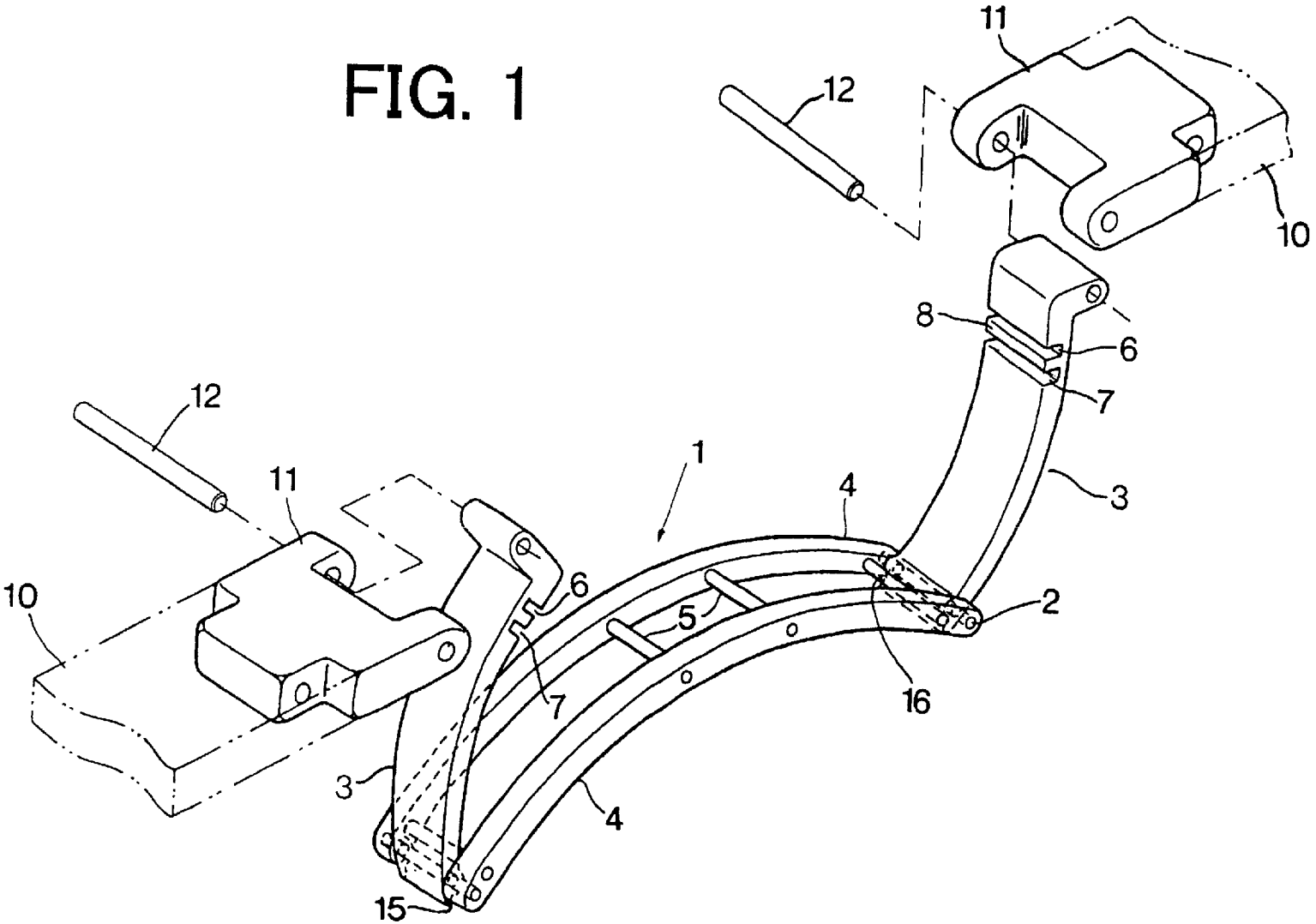
FIG. 1 is a perspective view of a first embodiment of the present invention adapted to a watchband.
Figure 2:
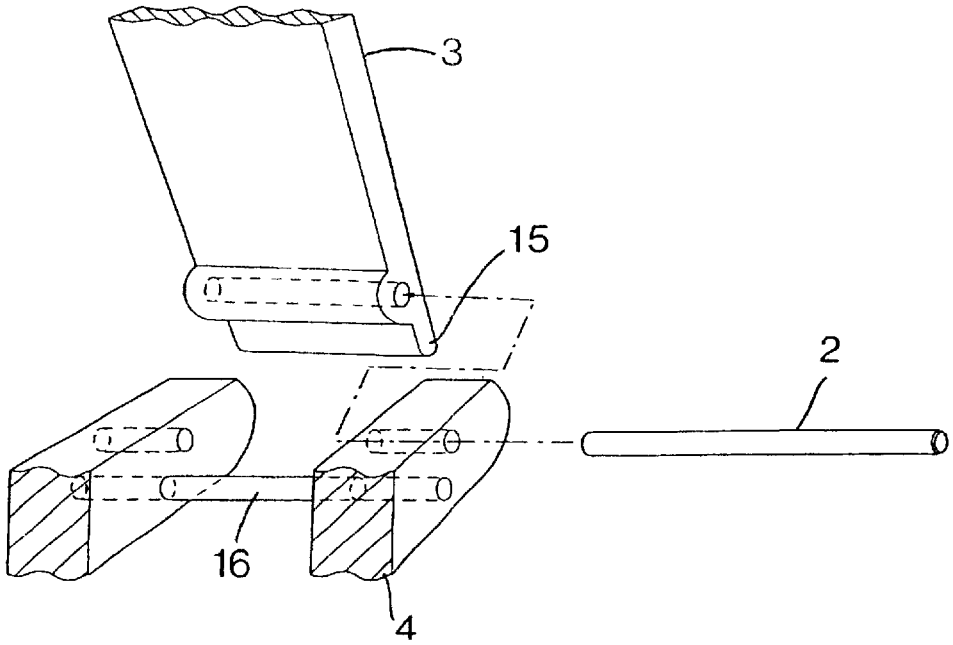
FIG. 2 is an exploded perspective view of amainportion of the present invention.
Figure 3:
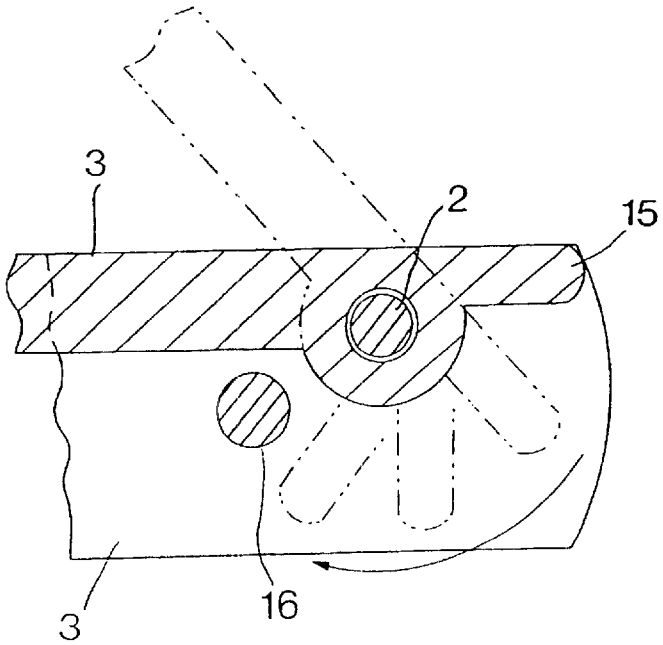
FIG. 3 is a sectional view of the main portion.

FIG. 1 is a perspective view of the first embodiment of the present invention applied to a watchband, FIG. 2 is an exploded perspective view of a main portion of the present invention, and FIG. 3 is a sectional view of the main portion.

Figure 28:
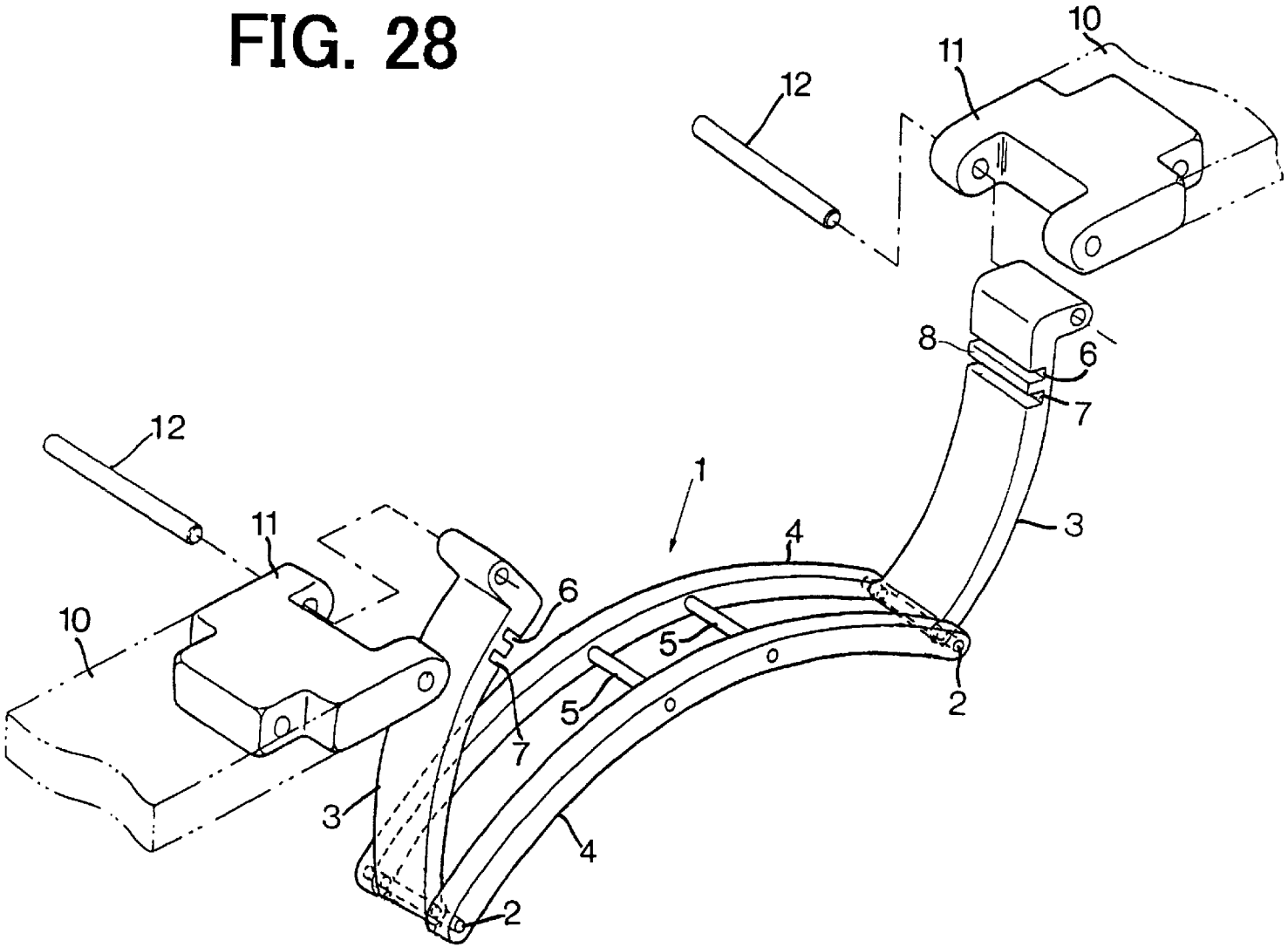
FIG. 28 is a perspective view showing a conventional opposed buckle.
Figure 29:
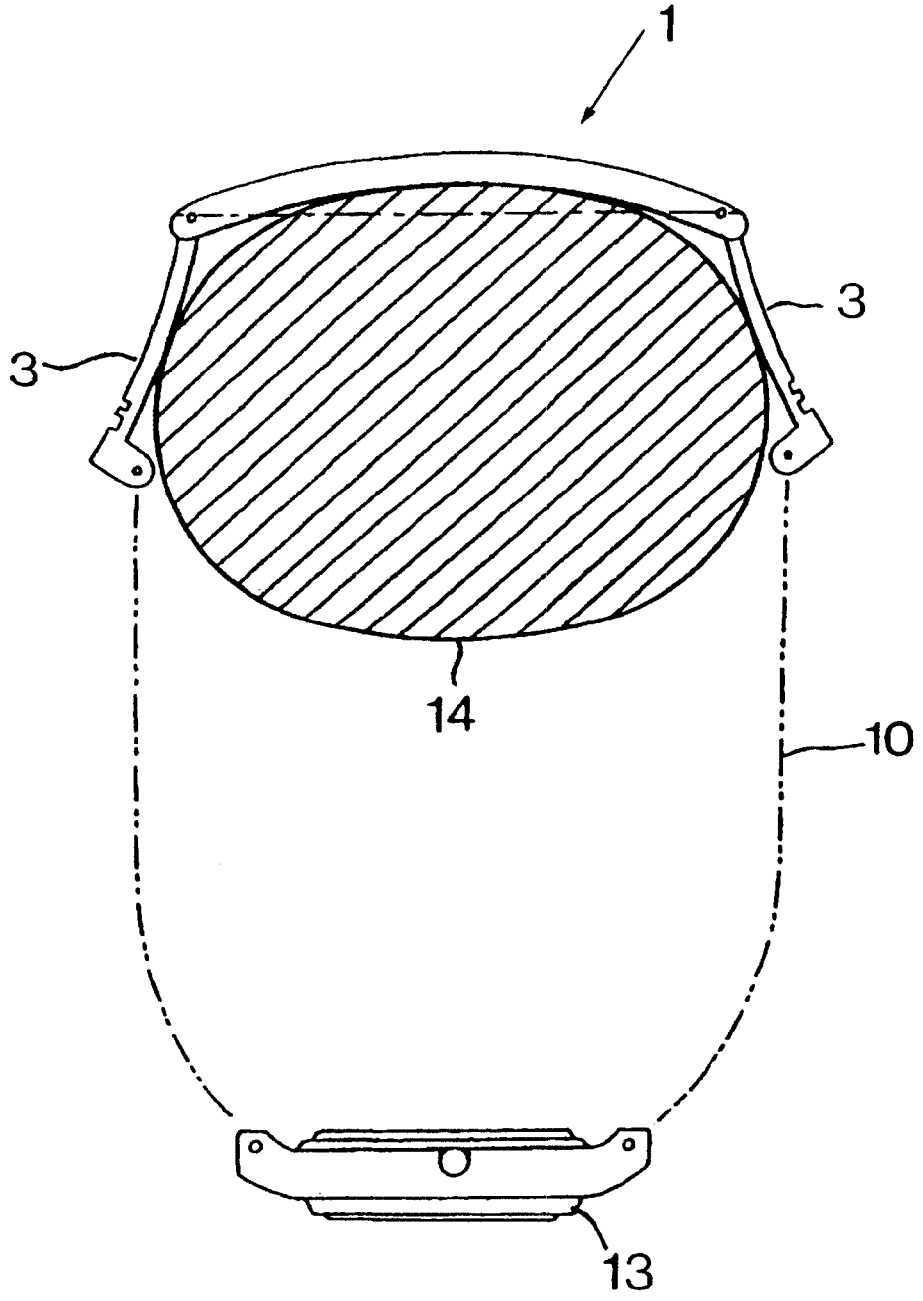
FIG. 29 is an illustration showing a wristwatch with the conventional buckle worn on a wrist.

In the figures, the same parts as those in FIG. 28 are shown by the same reference numbers as in FIG. 28, and the explanations thereof are omitted.

In the present embodiment, as shown in FIGS. 2 and 3, the base of each of the open plates 3 is extended in a longitudinal direction of the open plate from the portion where the pivot pin 2 is provided, thereby to form a stopper projection 15. In addition, a stop pin 16 which is a stopper member is securely attached by press fit into the frame members 4. The stop pin 16 is disposed at an inner lower side of the pin 2 so that the stopper projection 15 abuts against the stop pin 16.

Figure 4:
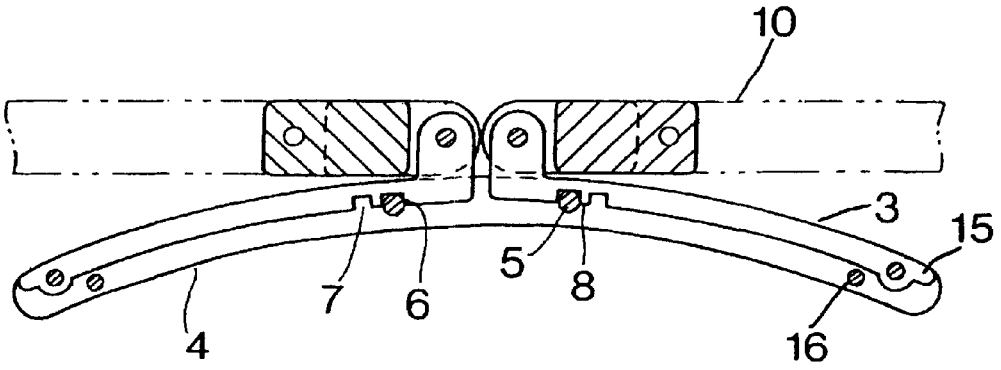
FIG. 4 is a sectional side view of a buckle when closed.

FIGS. 3 and 4 show the open plates when closed. An upper surface 3*a* of the open plate 3 is substantially flush with the upper surface of the frame members 4 of the base 1, or at least, does not protrude above the frame member.

The frame member 4 and the projection 15 are so disposed that, when the open plate 3 is rotated as shown by the dot-dash line in FIG. 3, the tip end of the projection 15 does not project out from the end portion of the frame member 4. Thus the projection 15 does not injure the wrist of the wearer during the operation.

In addition, under the closed condition as shown, the underside of the open plate 3 does not contact the stop pin 16. As a result, the open plate 3 can be securely locked without interfering with the engagement between the groove 6 thereof and the pin 5. The stop pin 16 is provided under the open plate so as to be concealed by the open plate. Since the stop pin 16 is thus not exposed, the appearance of the buckle is not impaired.

In operation, when the open plates 3 are opened in order that the wristwatch may be worn, or be taken off, and the open plate 3 is halfway rotated, the stopper projection 15 abuts against the stop pin 16. Thus the rotation of the open plate 3 is stopped.

Figure 5:
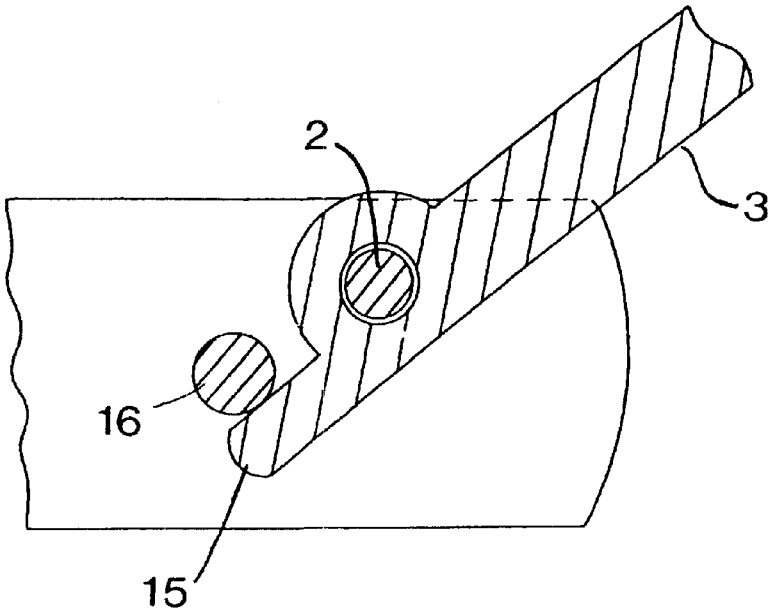
FIG. 5 is a sectional view showing an open plate when stopped.
Figure 6:
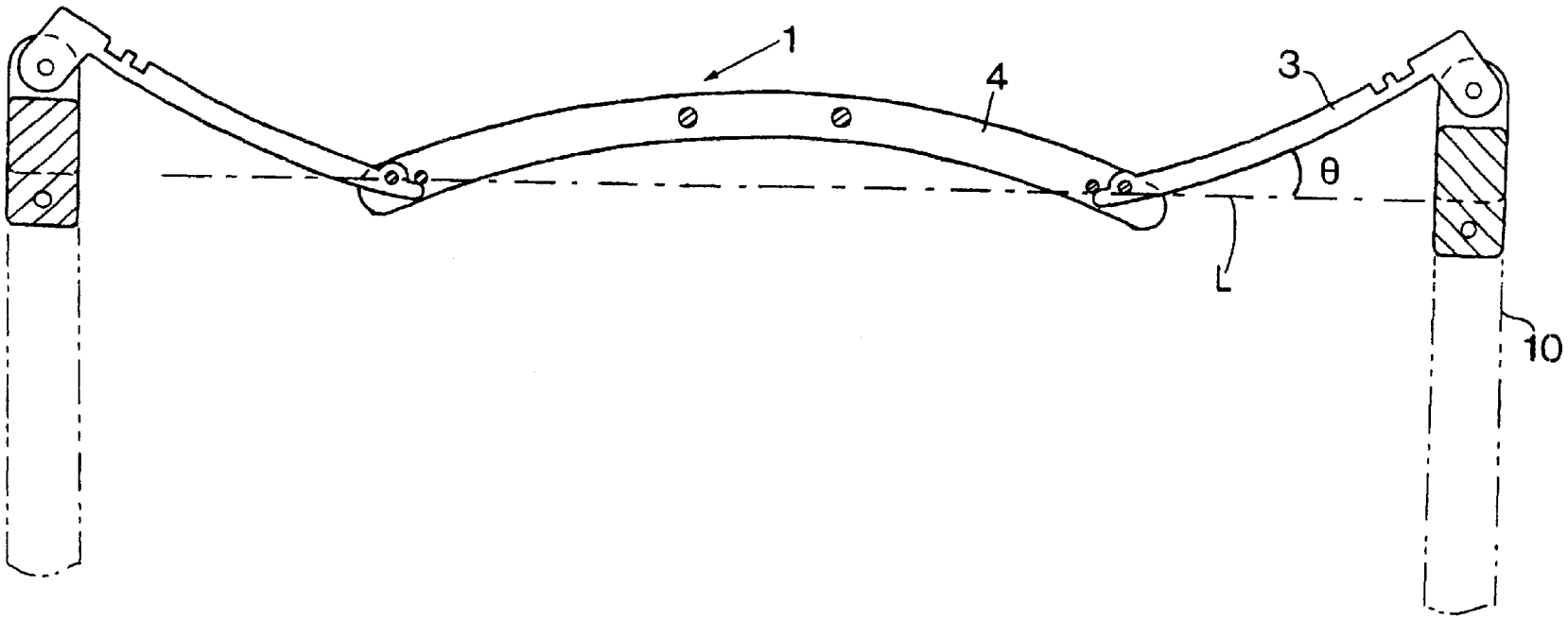
FIG. 6 is a sectional view showing the open plates when stopped.

FIGS. 5 and 6 are sectional views showing the open plates when stopped. At the stop positions, the open plates 3 are each held apart from the surface of the wrist. Thus the open plates can be easily held between the fingers and the angle of rotation thereof becomes small. Hence the operation for closing the open plates is facilitated.

An angle θ between the open plate 3 and a base line passing the pins 2 of the base 1 in FIG. 6 is preferably determined within a predetermined range as described hereinafter.

Figure 7:
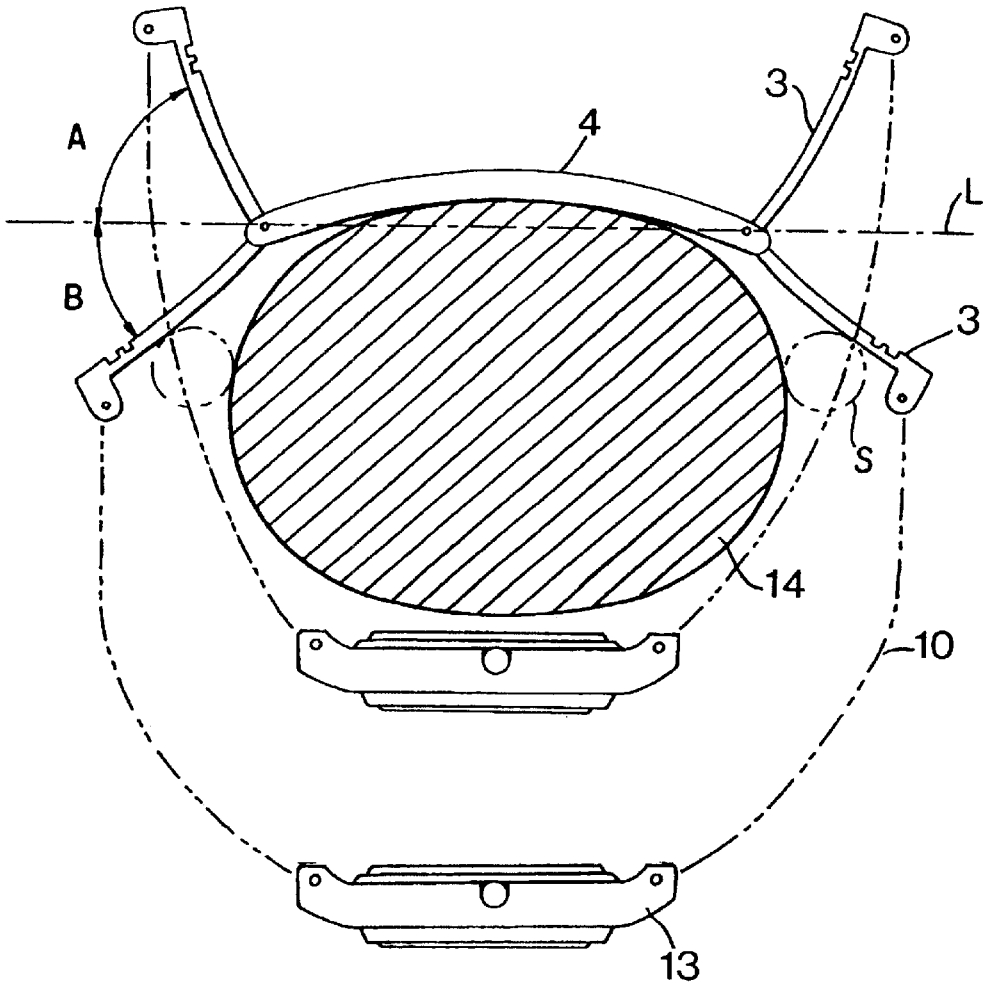
FIG. 7 is an illustration explaining a range of the angle at which the open plates stop.

FIG. 7 shows the range of the angle.

When one of the open plates 3 is closed, the plate 3 is held between the thumb and forefinger, or the forefinger is inserted in a space S in FIG. 7. Supposing that an angle of elevation above the line L is A and an angle of depression below the line L is B, as shown in the figure, as the elevation angle A increases, a ring formed by the watchband 10 and the buckle is flattened and shrunken. To the contrary, as the depression angle B increases, the ring formed by the band and the buckle is enlarged and approximates the true circle.

As the elevation angle A is increased, the closing operation becomes facilitated for the following reasons. Since the open plates 3 are distant from the surface of the wrist 14, the open plates 3 are easy to hold, and the rotating angle of the plates 3 necessary for closing becomes small. However, the gap between the band 10 and the wrist 14 is small so that it becomes troublesome to insert or draw out the wrist.

On the other hand, if the depression angle B is increased, the closing operation becomes difficult for the following reasons. Since the open plates 3 are close to the wrist 14, it is difficult to hold the plates and, in addition, the rotating angle is increased. However, the gap between the band 10 and the wrist 14 is large so that the inserting and drawing out of the wrist is facilitated.

Namely, the elevation angle and the depression angle are determined in consideration to the facility with which the closing of the open plates and inserting and drawing out of the wrist from the band are carried out. The rotation of the open plates must be stopped between such appropriate elevation angle and depression angle. The upper limits of angles of the appropriate elevation and depression angles are determined correlative to the following factors.

The thickness of the wrist and the size of the palm

The size of the buckle, more particularly, the length of the frame member 4 with respect to the longitudinal direction of the band 10

The length of the open plate 3

The length of the band (In the case of a wristwatch, it can be considered as the sum of the length of the watch 13 and the length of the band 10.)

The inner circumference of a ring formed by the band and the buckle

The thickness of the band (In the case of a wristwatch, it can be considered as the thickness of the watch 13 or the band 10.)

In addition, other factors such as the flexibility of the band is considered. (In the case of a wristwatch, it can be considered as the flexibility of the band 10.)

Hence, in the wristwatch, the upper limit of the elevation angle A is so determined that the inner circumference of the ring formed by the band and the buckle may be slightly larger than the palm and the outer circumference of the wrist, the watch 13 at the lower hanging portion of the ring formed by the band does not contact the wrist, and that the wrist can be inserted and drawn out with ample space.

The lower limit of the depression angle is so determined that the space between the open plates and the wrist is large enough to allow a finger of the wearer to be inserted, and that the open plates do not touch the wrist.

In accordance with these conditions, the upper limit of the elevation angle is determined at 65 degrees, and the lower limit of the depression angle is determined at 85 degrees.

The elevation angle and the depression angle are preferably 50 degrees and 70 degrees, respectively, and more preferably, 35 degrees and 55 degrees, respectively. More preferably, the elevation angle and the depression angle are 20 degrees and 40 degrees, respectively, and most preferably, 10 degrees and 30 degrees, respectively.

These angles can be set as appropriate by changing the position where the stopper projection 15 contacts the stop pin 16.

Figure 8:
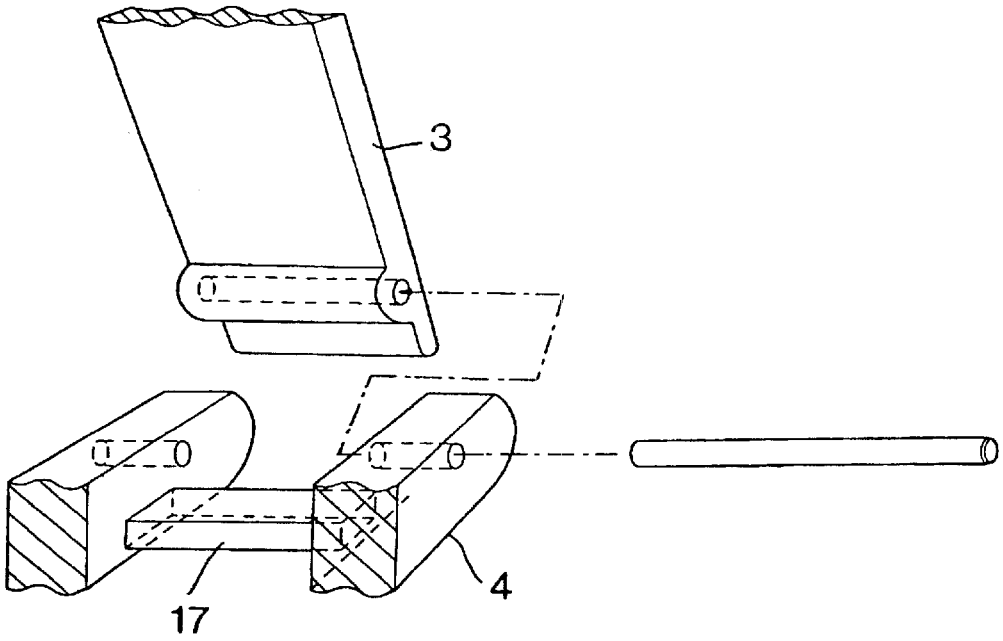
FIG. 8 is a perspective view of a modification of the first embodiment.
Figure 9:
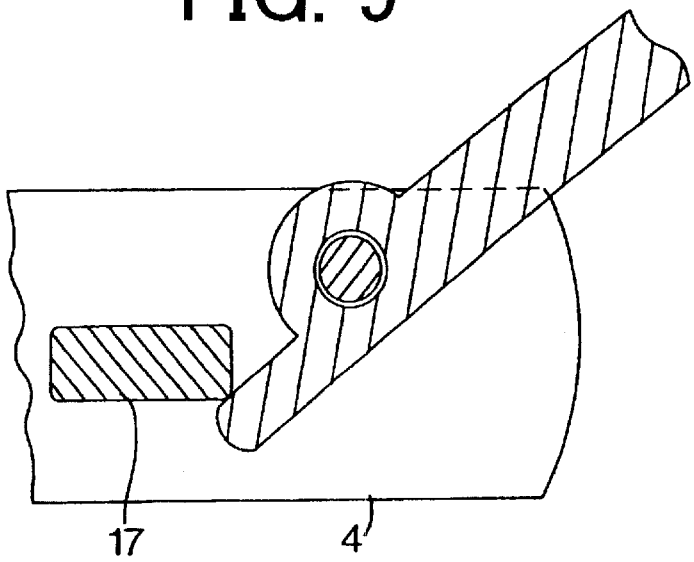
FIG. 9 is a sectional view of the modification of the first embodiment.

FIG. 8 is a perspective view of a modification of the first embodiment, and FIG. 9 is a sectional view thereof.

In the modification, a stop plate 17 integral with the frame members 4 is provided instead of the stop pin. The stop plate 17 which extends between the frame members 4 reinforces the base 1 of the buckle. Other operations and effects are the same as those of the first embodiment.

Figure 10:
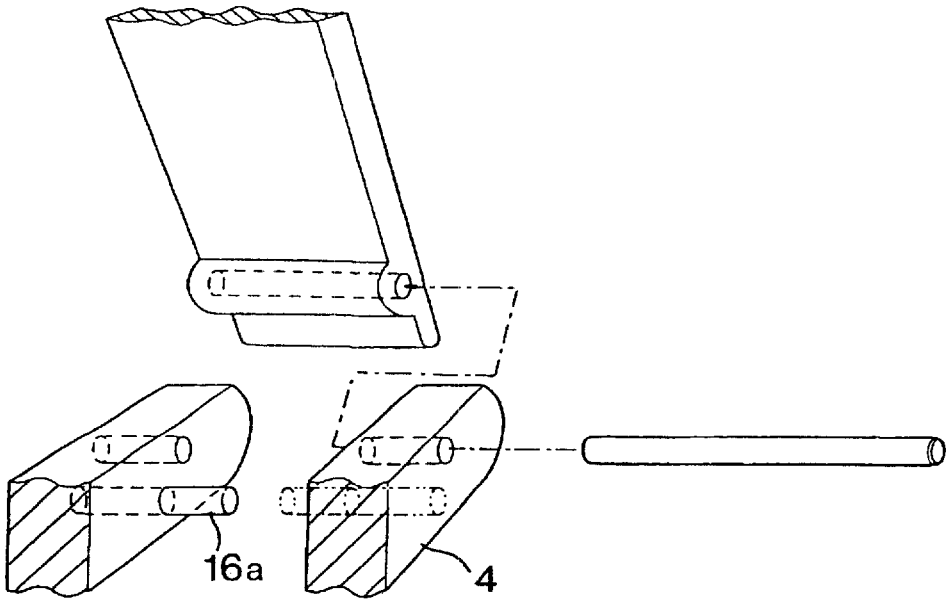
FIG. 10 is a perspective view of a modification of the first embodiment.
Figure 11:
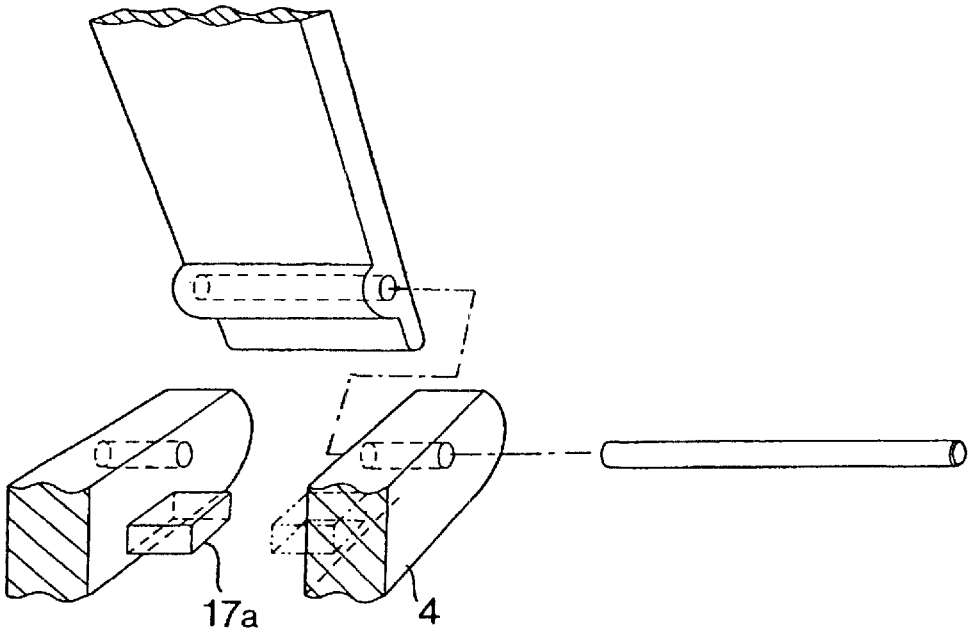
FIG. 11 is a perspective view of a modification of the first embodiment.

FIGS. 10 and 11 are perspective views showing other modifications of the aforementioned two examples.

In the example shown in FIG. 10, a pair of short pins 16*a* are press fit into the frame members 4, and in the example of FIG. 11, a pair of short stop plates 17*a* are integrally formed with the frame members 4.

As shown by the dotted lines in both figures, one of the pins and plates may be omitted. Hence the weight of the buckle can be decreased in both examples.

Figure 12:
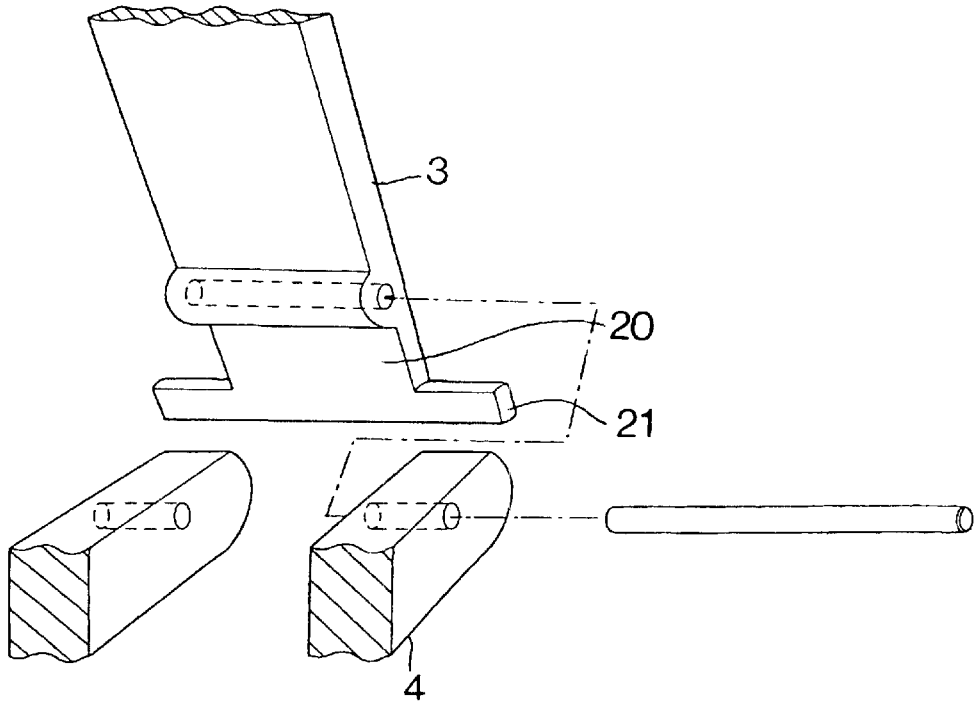
FIG. 12 is a perspective view of a second embodiment of the present invention.
Figure 13:
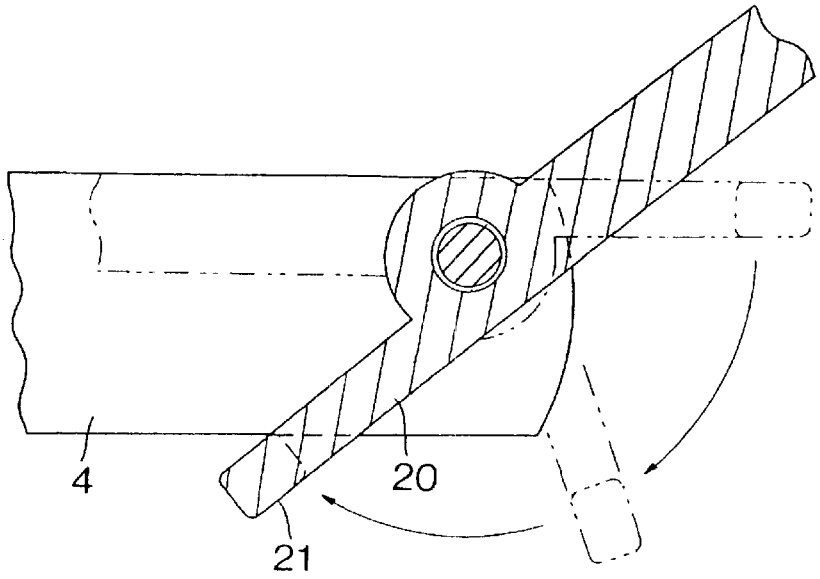
FIG. 13 is a sectional view of the second embodiment of the present invention.

FIG. 12 is a perspective view of the second embodiment of the present invention and FIG. 13 is a sectional view thereof.

In the present embodiment, an extended portion 20 is formed at the base of each of the open plates 3, and a pair of stop projections 21 are projected from both sides thereof in the lateral direction with respect to the longitudinal direction of the band.

As shown in FIG. 13, when the open plate 3 is rotated, the inner lower corner of the stop projection 21 abuts against the underside of the frame member 4 so that the open plate is held at a predetermined opening angle.

The present embodiment is suitable for a user having a wrist the width of which is smaller than the base 1, or for a buckle where the length of the base 1 is sufficiently longer than the width of the wrist. Namely, the embodiment is suitable in cases where the projections 21 do not contact the wrist.

In addition, since other stop members need not be provided, the machining is simplified.

Figure 14:
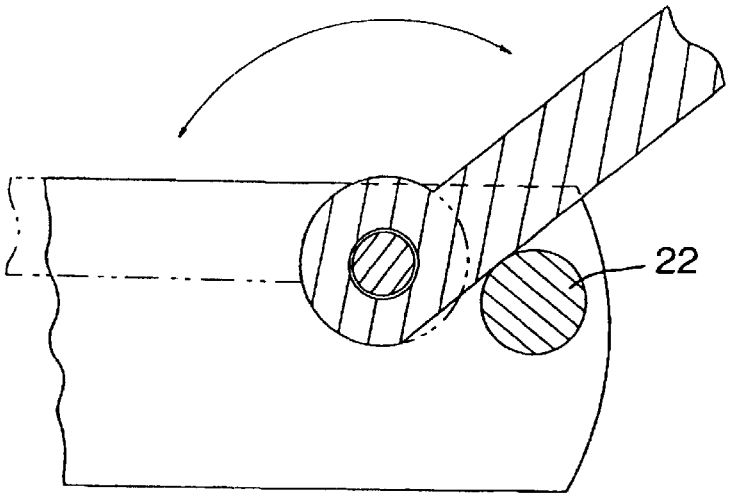
FIG. 14 is a sectional view of a third embodiment of the present invention.

FIG. 14 is a sectional view of the third embodiment.

In the present embodiment, a stop pin 22 is provided at the outer side of the pivot pin 2 so that, when the open plate 3 is opened, the open plate stops rotating when the upper surface thereof abuts against the pin 22.

In the present example, although the upper surface of the open plate 3 may be injured, it will not be a problem since the upper surface is concealed by the band when the watch is worn as shown in FIG. 4.

Figure 15:
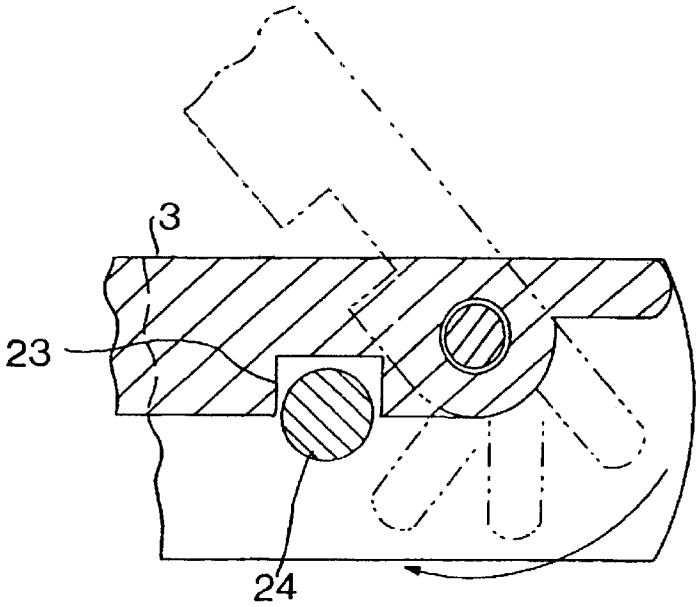
FIG. 15 is a sectional view of a modification of the first embodiment of the present invention.

FIG. 15 shows another modification of the first embodiment where a groove 23 is formed in the underside of the open plate 3, thereby enabling about a half of a stop pin 24 to be inserted therein.

In the present embodiment, the thickness of the open plate 3 can be increased to strengthen the plate.

Figure 16:
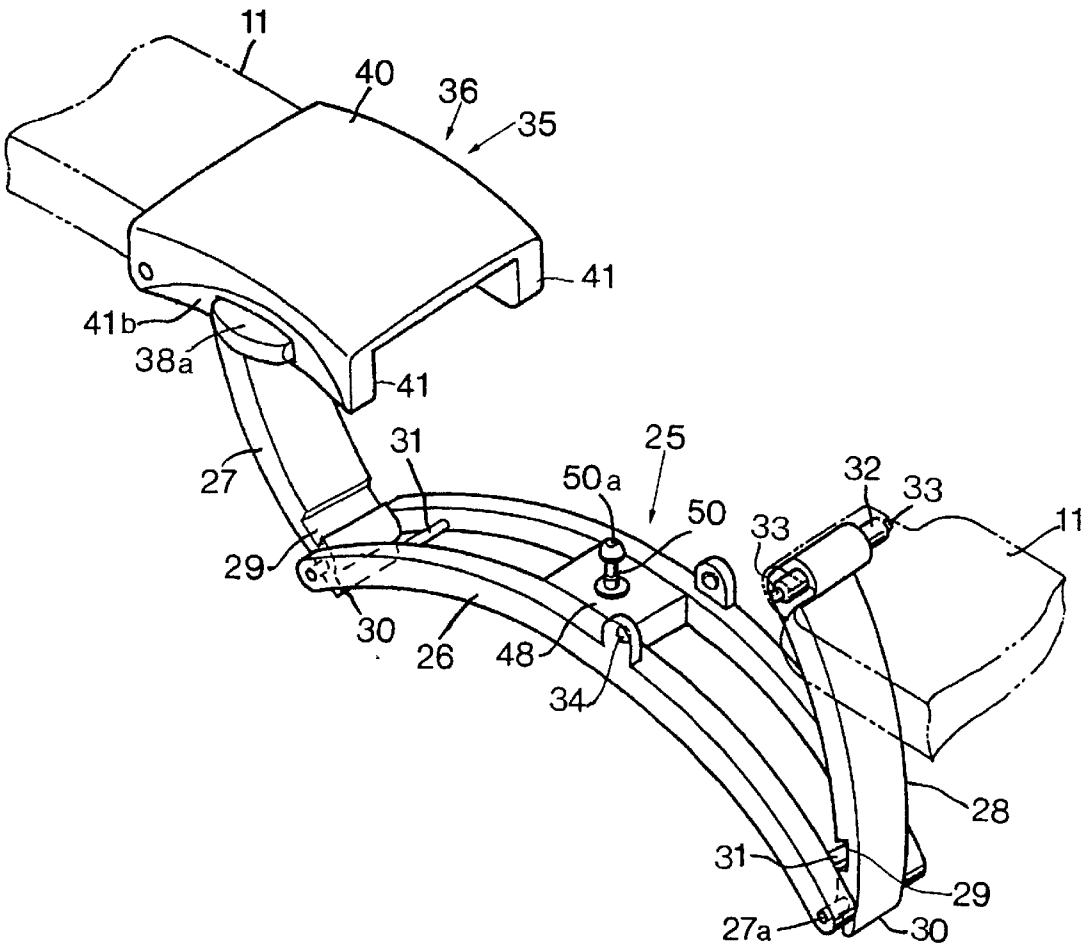
FIG. 16 is a perspective view of a fourth embodiment of the present invention.
Figure 17:
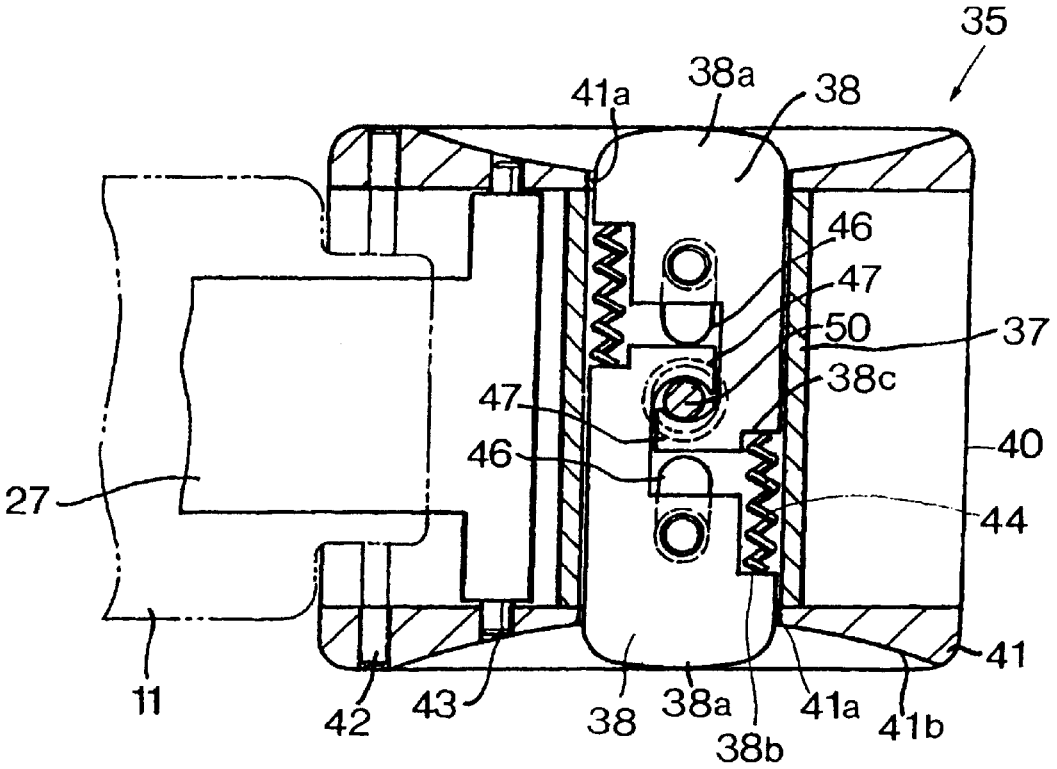
FIG. 17 is a sectional plan view of the fourth embodiment of the present invention.
Figure 18:
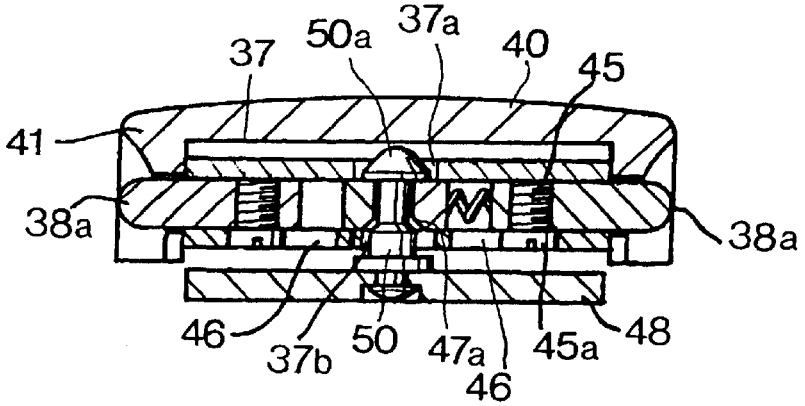
FIG. 18 is a sectional side view of the fourth embodiment.

FIG. 16 is a perspective view of the fourth embodiment, FIG. 17 is a sectional plan view, and FIG. 18 is a sectional side view thereof. In the embodiment, a depressible lock device as a grasping means is used so that push buttons are depressed to release the grasp of open plates.

A pair of open plates 27 and 28 are pivotally mounted on end portions of frame members 26 provided in a base 25. In the present embodiment, the same stopping structure as that of the first embodiment is used. Hence, projections 30 and stop pin 31 are provided, and a relief groove 29 similar to that shown in FIG. 15 is formed.

At the tip end of the open plate 28, there is provided a spring-loaded pin 32 having a pair of engaging projections 33 each engaging with a hole 34 formed in a lug of the frame member 26. The end of each engaging projection 33 is formed into a hemisphere so that when the pin is forcibly pushed or pulled, the engaging projections are retracted, thereby enabling to attach the open plate to the frame members or release the plate therefrom.

At the end of the other open plate 27, there is provided a lock device 35 provided with push buttons. The lock device 35 has an upper cover 36 which serves as an upper plate of a buckle, guide member 37 attached inside the upper cover 36, and a pair of push buttons 38 slidably inserted in the guide member 37 in the lateral direction of the band.

The upper cover 36 comprises an upper plate 40 and a pair of side plates 41, and is rotatably connected to the link 11 of the band by a pin 42, and also to the open plate 27 by a pin 43.

The guide member 37 opposes an opening 41*a* between the side plates 41 and inserted therein.

Each of the push buttons 38 is constructed in a point symmetry and has a manipulating portion 38*a* which projects out from the opening 41*a* of the upper cover 36, and recesses 38*b* and 38*c* wherein return springs 44 for urging the push button outward are inserted.

A curved recess 41*b* is formed in each side plate 41 so that the manipulating portion 38*a* is covered. The outer end of the manipulating portion 38*a* does not project outward from the upper plate 40.

A screw 45 is fixed in each push button 38, and a head 45*a* of the screw 45 slidably engages an elongated hole 46 formed in the guide member 37 and held at the position shown in FIGS. 17 and 18 by the spring 44. Each push button 38 further has an engaging hook 47 having a downward slanting portion 47*a* (FIG. 18) at the inner side thereof. The engaging hooks 47 are so disposed to oppose each other, confronting a pair of holes 37*a*, 37*b* formed in the upper and plates of the guide member 37.

On the frame members 26, there is securely mounted a supporting plate 48 to which a lock pin 50 is attached. The lock pin 50 is inserted into the holes 37*a*, 37*b* and engages the hooks 47.

Describing the operation of the lock device 35, when the open plate 27 is closed, and the upper cover 36 is forcibly depressed, the lock pin 50 is inserted in the holes 37*a* and 37*b* of the guide member 37 of the upper plate. A conical head 50*a* of the lock pin 50 engages with the downward slant portion 47*a* of the engaging hook 47 of each push button 38 and pushes the engaging hook 47 outwardly against the urging of the spring 44. When the conical head 50*a* passes through the hook 47, the hook 47 is retracted by the spring 44 so as to engage the shaft of the lock pin 50. Hence the upper plate 40 and the open plate 27 are locked.

In order to release the buckle, the manipulating portions 38*a* of both push buttons 38 are simultaneously depressed so that the engaging hooks 47 are opened, thereby releasing the lock pin 50.

When the open plate 27 is released, the projection 30 of the open plate 27 abuts against the stop pin 31 so that the rotation of the open plate 27 is prevented.

Thus in the present invention, the grasping means may take any shape.

For example, examples of the grasping means of the opposed buckle are disclosed in Japanese Patent Application Laid Open 61-247403, Japanese Utility Model Application Laid Open 6-61112, Japanese Patent Application Laid Open 8-504651, Japanese Patent Application Laid Open 9-314, Japanese Patent 2681870, and Japanese Utility Model Registration 2551067.

Examples of the buckle having push buttons are disclosed in Japanese Utility Model Application Laid Open 51-137372, Japanese Utility Model Application Laid Open 1-112713, Japanese Utility Model Application Laid Open 7-30726, Japanese Patent Application Laid Open 8-316, Japanese Patent Application Laid Open 8-322614, and Japanese Utility Model Registration 2511516.

Figure 19:
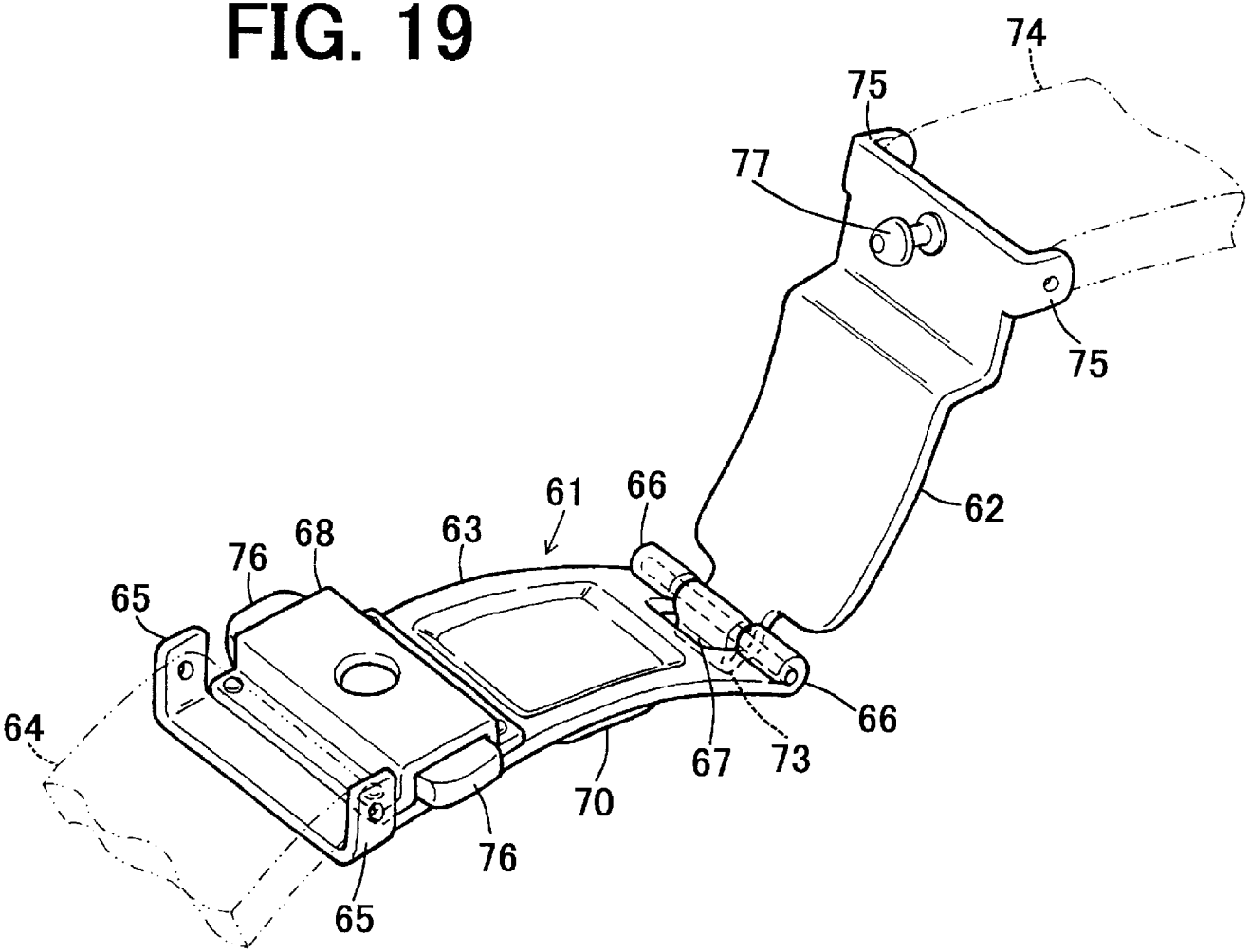
FIG. 19 is a perspective view of a fifth embodiment of the present invention.

FIG. 19 is a perspective view of the fifth embodiment.

The buckle of the present embodiment is a so-called double-folded buckle having a base 61 and a single open plate 62. The base 1 comprises a frame base plate 63 which is made by pressing a metal plate. At one end of the base plate 63, there are formed a pair of lugs 65 to which a band 64 is connected by a pin. At the other end, there are formed a pair of cylindrical portions 66 between which is formed a recess 67.

Figure 20:
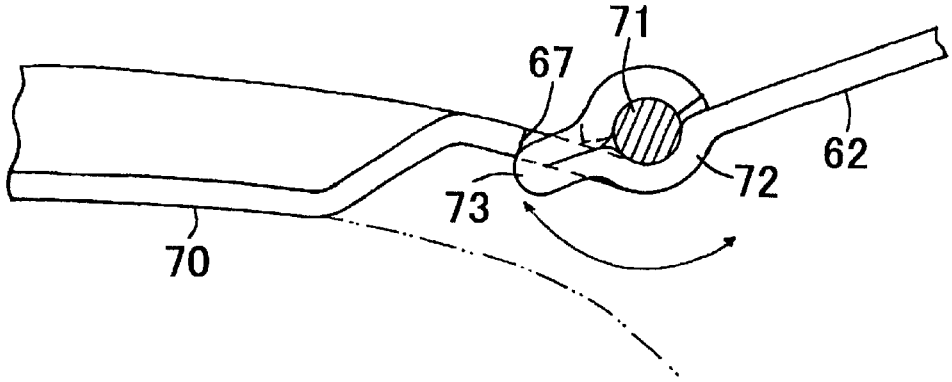
FIG. 20 is a side view showing a part of the fifth embodiment.

A lock device 68 of a similar construction to the lock device 35 shown in FIGS. 17 and 18, having only the body without the outer cover, is securely mounted on the base plate 63 adjacent the lugs 65. As shown in FIG. 20, at the center portion of the base plate 63, a downward projection 70 is formed.

On the other hand, the open plate 62 is also made of metal plate, and as shown in FIG. 20, at the center portion thereof, there is formed by bending, a cylindrical portion 72 and a stop pin 73 which are securely mounted on a connecting pin 71 connecting the open plate 62 with the base plate 63. The stop pin 73 is adapted to abut on the inner wall of the recess 67.

At the other end of the open plate 62, a pair of lugs 75 are formed so as to be connected to another band 74 by a pin, and further attached thereto is a lock pin 77 for locking with a pair of push buttons 76 of the lock device 68.

As shown in FIGS. 19 and 20, when the open plate 62 is opened, the stop pin 73 abuts on the inner wall of the recess 67 so that the open plate 62 is held. When the buckle is worn on the wrist, the projection 70 of the frame base plate touches the wrist so that the open plate 62 is maintained at a high position as shown in FIG. 20. Thus the stop pin 73 can be rotated without abutting on the wrist as shown by the arrow.

In accordance with the present embodiment, the buckle can be easily manufactured at a low cost by bending a plate. In addition, the buckle is light in weight. Since the buckle is connected to the band by the upright lugs 65 and 75, it is possible to connect a leather or resin band.

Figure 21:
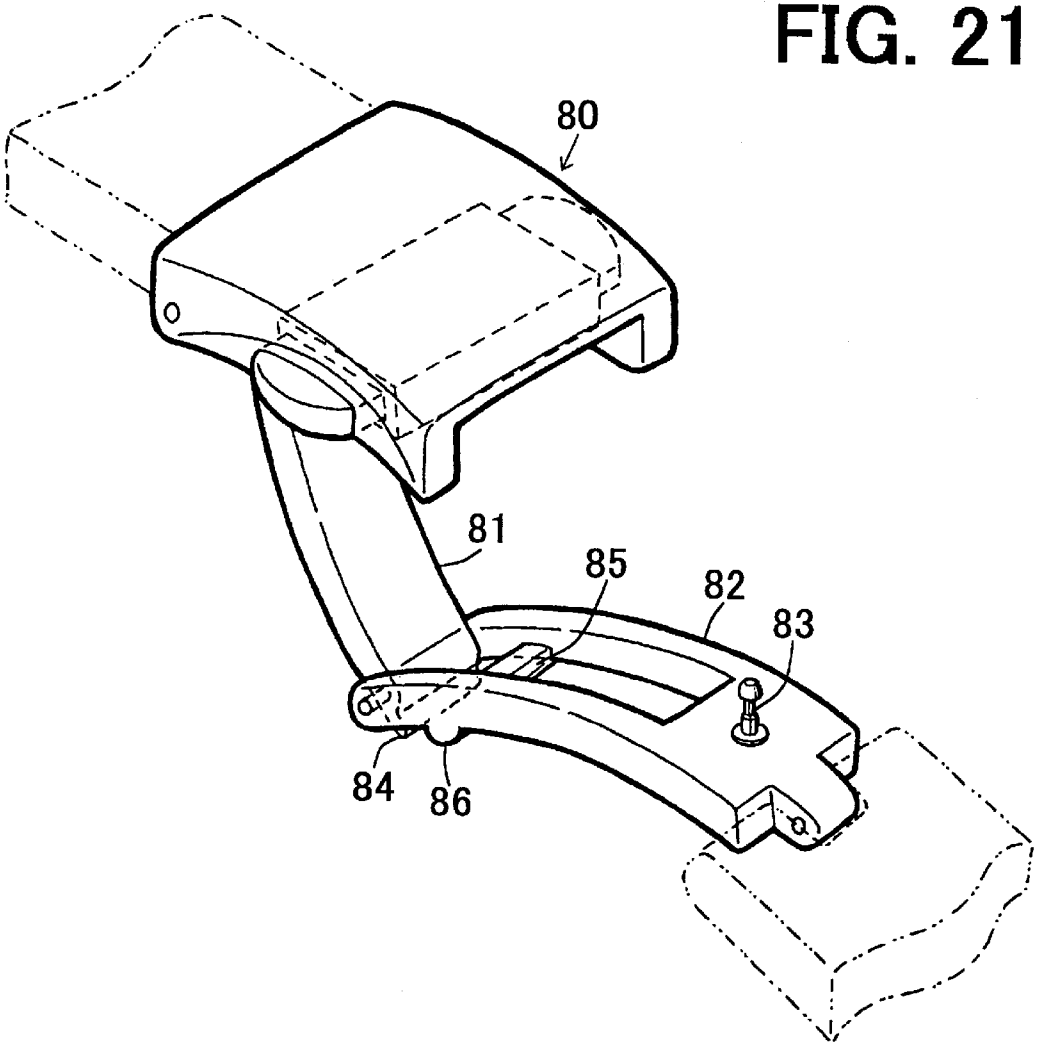
FIG. 21 is a perspective view of a sixth embodiment.

FIG. 21 is a perspective view of the sixth embodiment.

The buckle shown here is a so-called triple-folded buckle having a lock device 80 as an upper plate, open plate 81, and a frame member 82 as a base. The lock device 80 has the same construction as the lock device 35 shown in FIG. 16, and is so designed to lock a lock pin 83 attached to the frame member 82.

Figure 22:
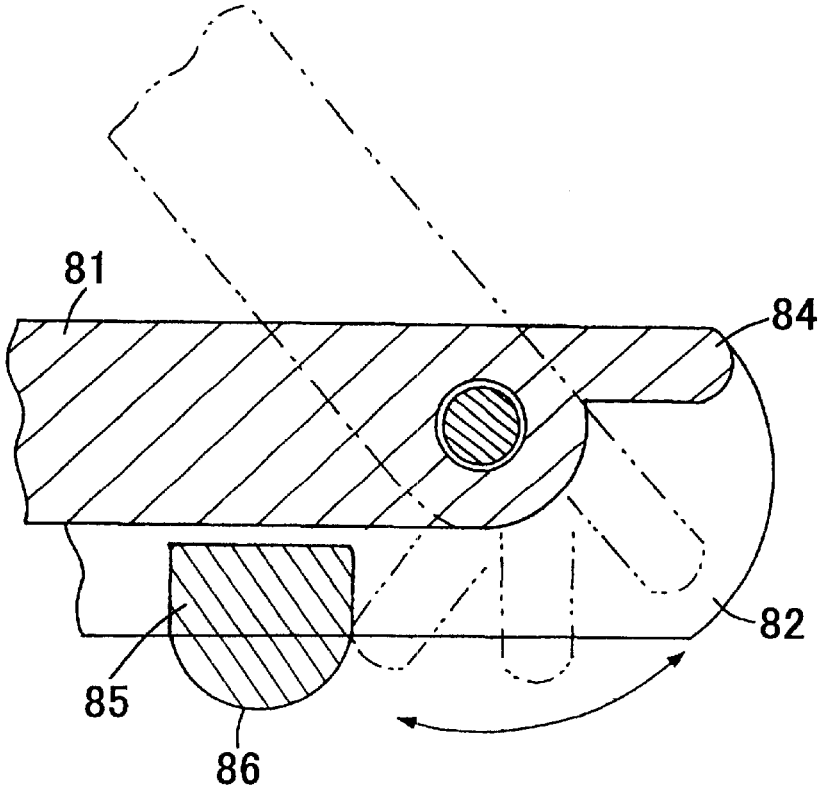
FIG. 22 is a sectional side view showing a part of the sixth embodiment.

As shown in FIG. 22, a stop pin 85 against which a stopper projection 84 abuts is provided with a downwardly projecting ridge 86 having a semicircular section.

Thus, when the watch is worn, the ridge 86 abuts on the wrist so that the stopper projection 84 is maintained at a high position, thereby preventing the projection 84 to contact the wrist.

In accordance with the present embodiment, since the stopper projection does not contact the wrist, the open plate can be smoothly rotated. In addition, the buckle can be comfortably worn.

Figure 23:
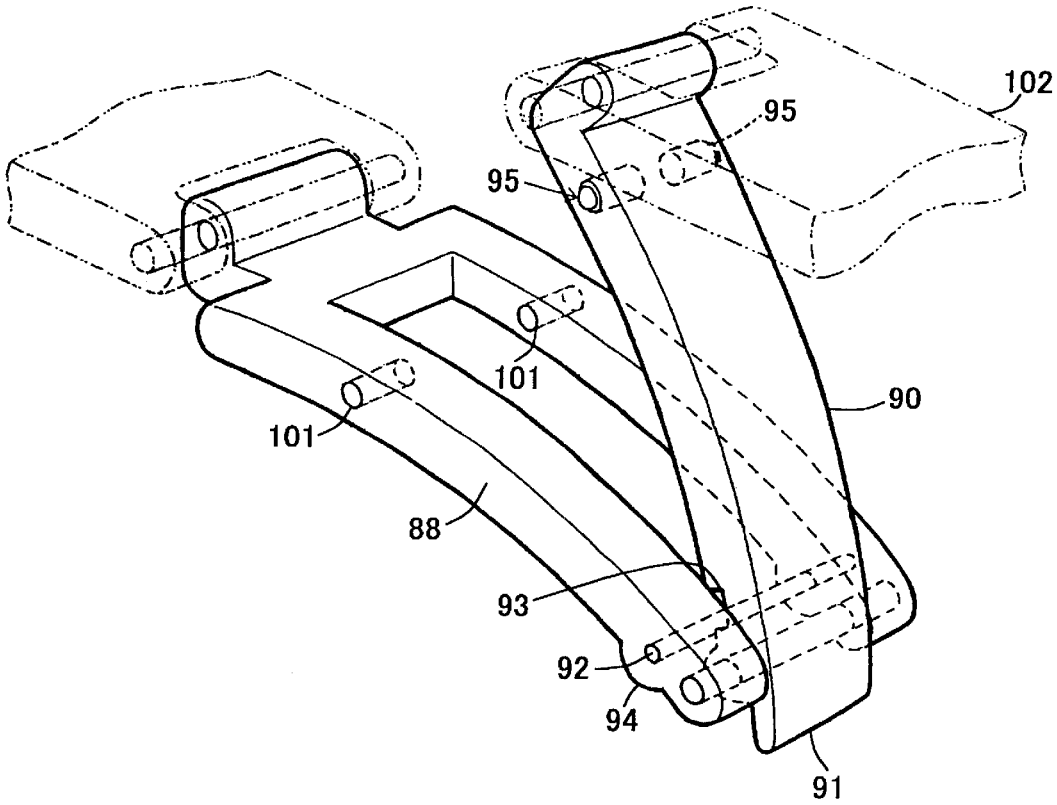
FIG. 23 is a perspective view of a seventh embodiment.
Figure 24:
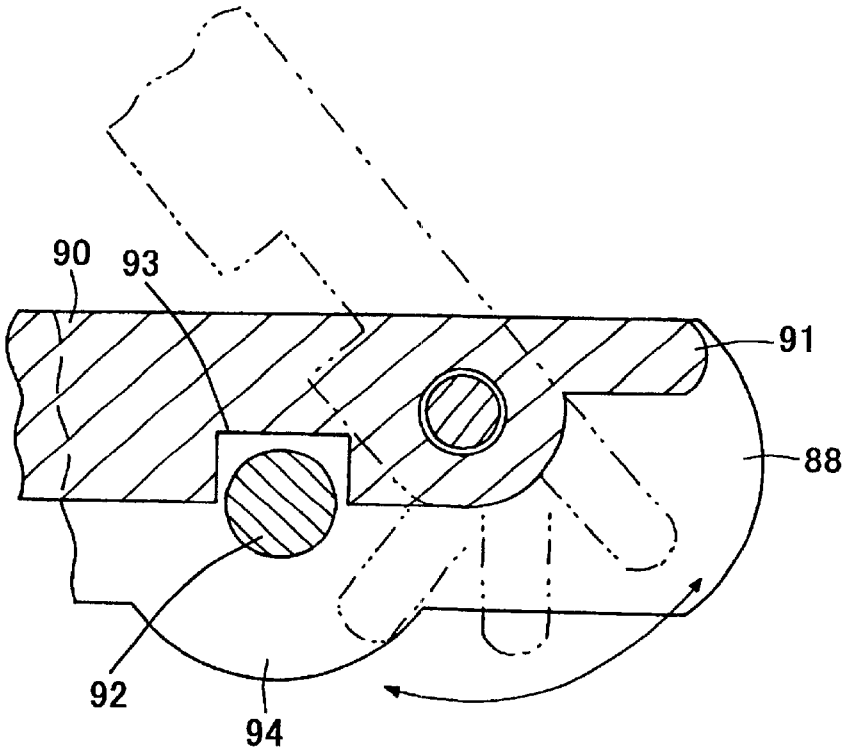
FIG. 24 is a sectional side view.
Figure 25:
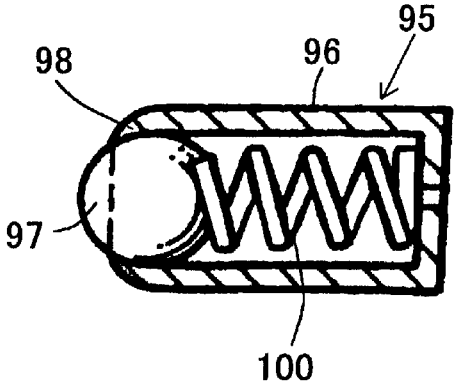
FIG. 25 is a sectional view of a ball lock device.

FIG. 23 is a perspective view of the seventh embodiment, FIG. 24 is a sectional side view, and FIG. 25 is a sectional view of the ball lock device.

The buckle comprises a U-shaped frame member 88 as a base and a single open plate 90. The open plate 90 is adapted to fit into the frame member 88 as in each of the hereinbefore described embodiments, and a stopper projection 91 at the base portion thereof is adapted to abut against a stop pin 92 provided in a groove 93 of the frame member 88.

A semicircular projection 94 is formed below the pin 92 of the frame member 88 so as to prevent the projection 91 from touching the wrist.

A ball lock device 95 is embedded at each side of the open plate 90 at the end portion thereof. As shown in FIG. 25, the ball lock device 95 comprises a ball 97 inserted in a holding cylinder 96 having an open end, and a spring 100 for pressing the ball against a flange portion 98. The ball 97 projects out of the outer wall of the open plate 90 and engages with one of a pair of holes 101 formed in the inner walls of the frame member 88.

Hence when the open plate 90 is forcibly pressed against the frame member 88, each ball 97 is depressed into the cylinder 96 against the urging of the spring 100. When the position of the ball 97 coincides with that of the hole 101, the ball projects out so as to be engaged therewith, thereby locking the open plate. On the other hand, the locked open plate 90 is released by forcibly pulling a band 102 connected thereto to temporarily retract the ball 97.

The ball lock device may be provided only on one side.

In accordance with the present embodiment, since the stop projection 91 does not touch the wrist, the rotation of the open plate becomes smooth. Due to the projection 94, the size of the frame member in the vertical direction can be decreased, thereby decreasing the thickness of the buckle.

Figure 26:
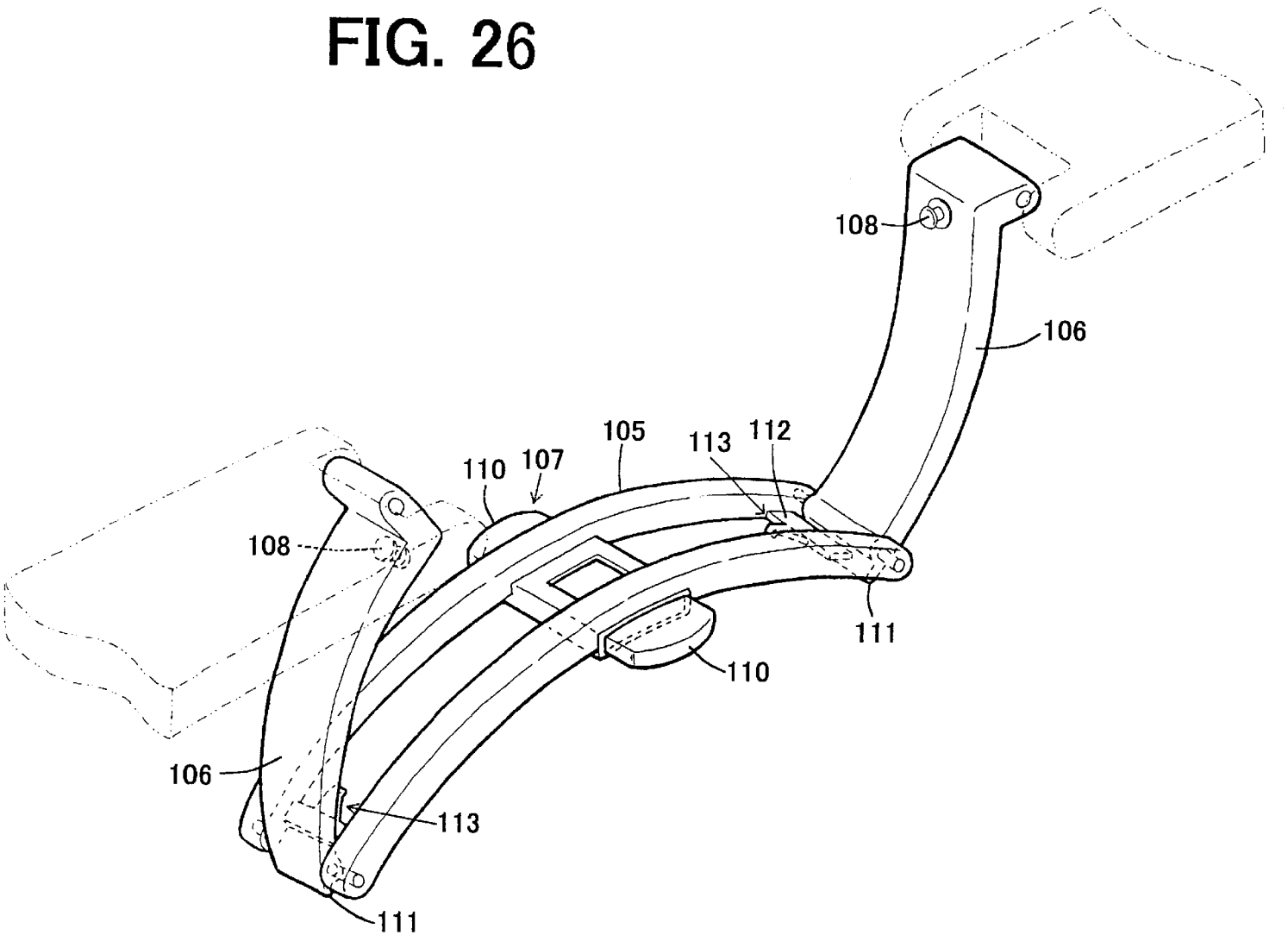
FIG. 26 is a perspective view of an eighth embodiment.
Figure 27:
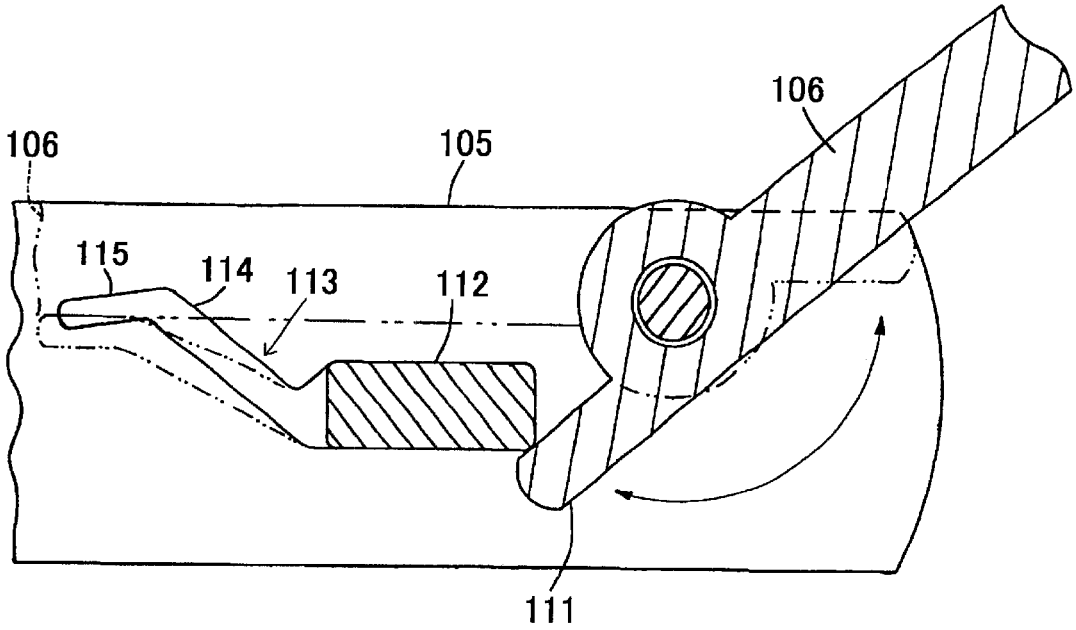
FIG. 27 is a sectional side view of the eighth embodiment.

FIG. 26 is a perspective view of the eighth embodiment and FIG. 27 is a sectional side view thereof.

The present buckle is an opposed buckle having a frame member 105 as a base and a pair of open plates 106 mounted on both ends of the frame member 105. A lock device 107 having only the body is attached to the frame member 105 at the center thereof.

Meanwhile, at an end portion of each open plate 106, a lock pin 108 is provided. Thus, engaging hooks (not shown) of push buttons 110 of the lock device 107 engages with the lock pins 108.

In the frame member 105, there are integrally formed a pair of stop plates 112 against which stop projections 111 of the open plates 106 abut.

In the present embodiment, there is provided a releasing leaf spring 113 projecting inward from each stop plate 112. As shown in FIG. 27, the leaf spring 113 comprises an upwardly inclined slant portion 114 and a flat portion 115 at the upper end thereof. When the open plate 106 is closed as shown by the chain line, the underside of the open plate renders the leaf spring 113 to yield downward as shown by the chain line, thereby urging the open plate 106 upward.

Thus, when the push buttons 110 of the lock device 107 are depressed, the open plates are automatically sprung up by the leaf springs 113 and rotated, and stop when abutted against the stop plates 112.

In accordance with the present embodiment, when the push buttons are depressed, the open plates automatically spring up and stop at predetermined positions so that the opening operation is simplified.

PROBABILITY OF INDUSTRIAL EXPLOITATION

In accordance with the present invention, the open plates are maintained at positions apart from the wrist so that the buckle can be easily handled.

What is claimed is:

1. A device for limiting a rotation of an open plate provided in a buckle for a personal adornment band, comprising:

a base;

the open plate being rotatably connected by a pivot at least one end of the base;

holding means for holding the open plate at a closed position;

stopping means for stopping the open plate halfway of an opening operation; and the open plate being allowable to be rotated in open and close directions in a range between a halfway position stopped by the stopping means and the closed position held by the holding means.

2. The device according to claim 1 wherein the stopping means is a stop member provided on the base so as to abut against a part of the open plate.

3. The device according to claim 2 wherein a projection is formed to project outwardly from the base portion of the open plate so as to abut against the stop member.

4. The device according to claim 3 wherein the projection does not project out of the base during the rotation of the open plate.

5. The device according to claim 1 wherein the stopping means is an elongated member securely attached to the base at an inner side of the pivot of the open plate.

6. The device according to claim 1 wherein the stopping means is an elongated member securely attached to the base at an outer side of the pivot of the open plate.

7. The device according to claim 1 wherein an upper surface of the open plate is either flush with or in a position lower than a position of an upper surface of the base.

8. The device according to claim 1 wherein the stopping means comprises an extended portion projecting outward from a base portion of the open plate, and a pair of projections projecting in the lateral directions from the extended portion, and a part of each projection adapted to abut against the underside of the base.

9. The device according to claim 1 wherein the holding means is a lock device having push buttons.

10. The device according to claim 1 wherein the holding means comprises a ball urged by a spring and mounted in the open plate, and a hole formed in the base for engaging with the ball.

11. The device according to claim 1 wherein a projection is formed on the base to project downward from the underside of the base so as to contact a wrist so that the stopping means is disposed apart from the wrist.

12. The device according to claim 1 wherein the base and the open plate are each formed by bending a metal plate.

13. The device according to claim 1 wherein a spring is provided for springing up the open plate when the open plate is released.

14. The device according to claim 1 wherein a part of said stopping means is inserted in a groove formed in the open plate.

15. The device according to claim 1 wherein the open plate is rotatably connected to a pair of cylindrical portions formed on the base, and the stop means is a recess formed between the cylindrical portions.

16. A device for limiting rotations of a pair of open plates provided in a buckle for a personal adornment band, the buckle comprising a base, the open plates rotatably connected to both ends of the base and adapted to be oppositely opened from closed positions, and holding means for holding the open plates at closed positions, wherein stopping means is provided for stopping the open plates halfway of an opening operation, and an angle formed between the open plate and a base line passing joints of the open plate at the stop positions thereof is within a range between about 65 degrees in the angle of elevation and about 85 degrees in the angle of depression.

17. The device according to claim 16 wherein the angle is in a range between about 10 degrees in the angle of elevation and about 30 degrees in the angle of depression.

18. The device according to claim 16 wherein the angle of the open plates at the stop positions is so dimensioned that a finger of a wearer can be inserted between a wrist and each open plate.

19. The device according to claim 16 wherein a ring formed by the personal adornment band and the buckle connected to the end of each open plate at the stop position is so dimensioned that a wrist can be inserted with a gap.

20. A device for limiting rotations of a pair of open plates provided in a buckle for a personal adornment band, the buckle comprising a base, the open plates rotatably connected to both ends of the base and adapted to be oppositely opened from closed positions, and holding means for holding the open plates at closed positions, wherein stopping means is provided for stopping the open plates halfway of an opening operation, and an inner circumference of a ring formed by the personal adornment band and the buckle connected to the end of each open plate at the stop positions thereof is slightly larger than an outer circumference of a wrist.

21. The device according to claim 20 wherein the ring formed by the personal adornment band and the buckle at the stop position of the open plates is so dimensioned that a wrist can be inserted with a gap.

22. The device according to claim 20 wherein the lower hanging portion of the ring formed by the personal adornment band at the stop positions of the open plates does not contact the wrist.

23. A device for limiting rotations of a pair of open plates provided in a buckle for a personal adornment band, the buckle comprising a base, the open plates rotatably connected to both ends of the base and adapted to be oppositely opened from closed positions, and holding means for holding the open plates at closed positions, wherein stopping means is provided for stopping the open plates halfway of an opening operation, and the open plates do not touch a wrist of a wearer at the stop positions thereof.

24. The device according to claim 23 wherein a gap for inserting a finger of the wearer is formed between each open plate and the wrist at the stop position thereof.

25. A device for limiting a rotation of an open plate provided in a buckle for a personal adornment band, the buckle comprising a base, the open plate rotatably connected to at least one end of the base, holding means for holding the open plate at a closed position, and stopping means for stopping the open plate halfway of an opening operation.

26. A wristwatch provided with a band having buckle comprising a base, a pair of open plates rotatably connected to both ends of the base and adapted to be oppositely opened from closed positions, and holding means for holding the open plates at the closed positions, further comprising stopping means for stopping the open plates halfway of an opening operation.

* * * * *